United States Patent [19]

Davis et al.

[11] Patent Number: 4,479,588

[45] Date of Patent: Oct. 30, 1984

[54] SEALED CARTON WITH TAMPER INDICATING MEANS

[75] Inventors: Robert E. Davis, Nutley; Patrick S. Maio, Ringwood, both of N.J.; Lawrence J. Growney, Pearl River, N.Y.

[73] Assignee: Federal Paper Board Company, Inc., Montvale, N.J.

[21] Appl. No.: 443,754

[22] Filed: Nov. 22, 1982

[51] Int. Cl.[3] ..... B65D 5/02; B65D 17/00

[52] U.S. Cl. ..... 220/416; 206/622; 206/634; 206/807; 229/37 R; 229/38

[58] Field of Search ..... 229/37 R, 38, 39 R, 229/80; 206/247, 807, 622, 634; 220/416, 417, 418

[56] References Cited

U.S. PATENT DOCUMENTS

| | | | |
|---|---|---|---|
| 221,244 | 11/1879 | Matchett | 220/416 X |
| 312,851 | 2/1885 | Heron | 229/38 |
| 1,234,917 | 7/1917 | McClay | 229/38 |
| 1,511,047 | 10/1924 | Bockhorst, Sr. | 229/38 |
| 2,758,780 | 8/1956 | Imbs | 220/416 X |
| 2,963,209 | 12/1960 | Hovland | 206/622 X |
| 3,062,430 | 11/1962 | Rutledge | 220/416 X |
| 3,451,535 | 6/1969 | Caplan | 229/39 R X |
| 3,833,165 | 9/1974 | Hoiles | 229/37 R |
| 3,894,680 | 7/1975 | Araki | 206/622 X |
| 4,049,190 | 9/1977 | O'Neill | 229/37 R X |

FOREIGN PATENT DOCUMENTS

| | | | |
|---|---|---|---|
| 26874 | of 1906 | United Kingdom | 229/38 |
| 967202 | 8/1964 | United Kingdom | 229/37 R |

*Primary Examiner*—William T. Dixson, Jr.
*Assistant Examiner*—Gary E. Elkins
*Attorney, Agent, or Firm*—Charles A. Brown

[57] ABSTRACT

This relates to cartons or packages which are sealed in a manner wherein they cannot be opened no matter how careful one is without giving an indication of tampering. In one form of the invention, an outermost closure panel is provided with a tuck flap which extends down between inner and outer panels of a double wall carton body wall and the inner surface of the tuck flap is bonded to the exterior surface of an inner panel to provide an inaccessible bond. Panels of cartons which are bonded together and have an accessible seam may be provided with an arrangement of weakening lines so that if one attempts to destroy the bond using a knife or razor blade, the exposed outer panel will give evidence of rupturing and thus indicate tampering even though the two panels are later resealed. If desired, the inner of the two panels may also have an arrangement of weakening lines which match that of the exterior panel and the weakening lines may be arranged in rows extending transversely of the panels so that the bonded together panels may be readily torn to effect an opening of the package.

9 Claims, 10 Drawing Figures

SEALED CARTON WITH TAMPER INDICATING MEANS

This invention relates in general to new and useful improvements in cartons, and more particularly to a tamper resistant carton or package.

There has been available to the public sealed cartons or packages which under normal circumstances must be torn open. However, these sealed packages normally have adhesive bonds between terminal panels thereof which may be destroyed by the careful use of a knife or razor blade so that access can be had to the interior of the package without detection and the package can also be resealed without detection. This permits one to tamper with the contents of the package without any indication of tampering.

In accordance with this invention, there are provided several carton constructions which can not be opened and resealed without an indication of tampering.

First of all, there is provided a closure arrangement wherein the customary closure panel is provided with a tuck flap and this tuck flap is inserted between inner and outer panels of a double carton wall and the inner surface of the tuck flap is bonded to an outer surface of an interior wall of the double wall so as to provide a bond which is completely inaccessible.

In the formation, the aforesaid carton to have a double wall, as is customary, there is a terminal outer panel and a terminal inner panel or flap. The adhesive bond between the terminal outer panel and an interior panel is, of necessity, exposed at one edge of the terminal panel. In order that the bond between the terminal panel and the interior panel may not be opened without an indication of tampering, the terminal panel is provided with a series of weakening lines which form a tamper indicating means and which are ruptured during any attempt to destroy the bond between the terminal panel and the interior panel.

It is also feasible to provide a carton with a simple closure arrangement which will include an inner closure panel and an exterior closure panel adhesively bonded together in the customary manner. At least the outer closure panel will be provided with an arrangement of weakening lines so as to indicate any attempt to separate the two panels by destroying the bond therebetween. It is also feasible that both closure panels have an arrangement of weakening lines which are substantially identical and which weakening lines are arranged in rows which are aligned so as to provide rupture lines for ease of opening the carton.

With the above, and other objects in view that will hereinafter appear, the nature of the invention will be more clearly understood by reference to the following detailed description, the appended claims and the several views illustrated in the accompanying drawings.

Figure 1:
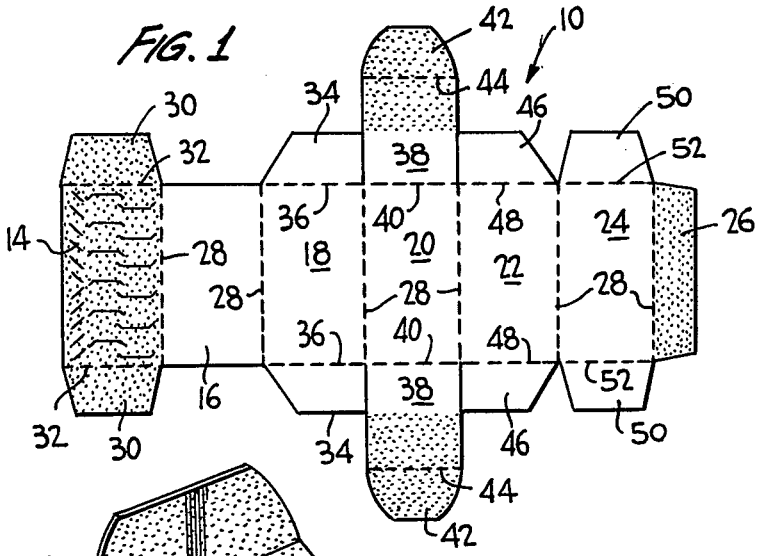
FIG. 1 is a plan view of a blank from which a rectangular cross sectional carton is formed in accordance with this invention.

Referring now to the drawings in detail, it will be seen that there is illustrated in FIG. 1 a carton blank 10 from which a carton 12, formed in accordance with this invention, is assembled. The carton blank 10 is particularly constructed for forming a four sided or wall carton having closure flaps and panels at opposite ends thereof.

The blank 10 has four wall panels arranged in a line and connected to each other. These wall panels, from left to right, include a terminal panel 14, an exterior panel 16, an exterior panel 18, a central panel 20, an interior panel 22, an interior panel 24 and an interior terminal panel 26 which may be in the form of a flap. The various panels 14–26 are foldable connected to one another by fold lines 28 which extend transversely of the blank and thus longitudinally of the height of the resultant carton body.

The terminal panel 14, which is an exterior panel, has foldably connected to the opposite ends thereof exterior closure flaps 30 by means of parallel fold lines 32. In a like manner, the exterior panel 18 has connected to opposite ends thereof closure flaps 34 by way of longitudinal fold lines 36.

The central panel 20 has connected to opposite ends thereof closure panels 38 along longitudinal fold lines 40 which are continuations of the fold lines 36. Each closure panel 38 has connected to the outer end thereof a tuck flap 42 by means of a longitudinal fold line 44.

The interior panel 22 has connected to the opposite ends thereof closure flaps 46 along fold lines 48 which are continuations of the fold lines 36, 40.

Finally, the interior panel 24 has at opposite ends thereof closure flaps 50 connected thereto along longitudinal fold lines 52 which are continuations of the fold lines 36, 40, 48.

In order that the carton blank 10 may be formed as a carton, at a minimum there is supplied to the terminal panel 14, the closure flaps 30, the tuck flaps 42 and either to the terminal flap 26 or an edge portion of the exterior panel 18 adjacent the fold line 28 a coating of adhesive. The adhesive may well be applied to portions of the closure panels 38 adjacent the tuck flaps 42 as indicated in FIG. 1.

Figure 2:
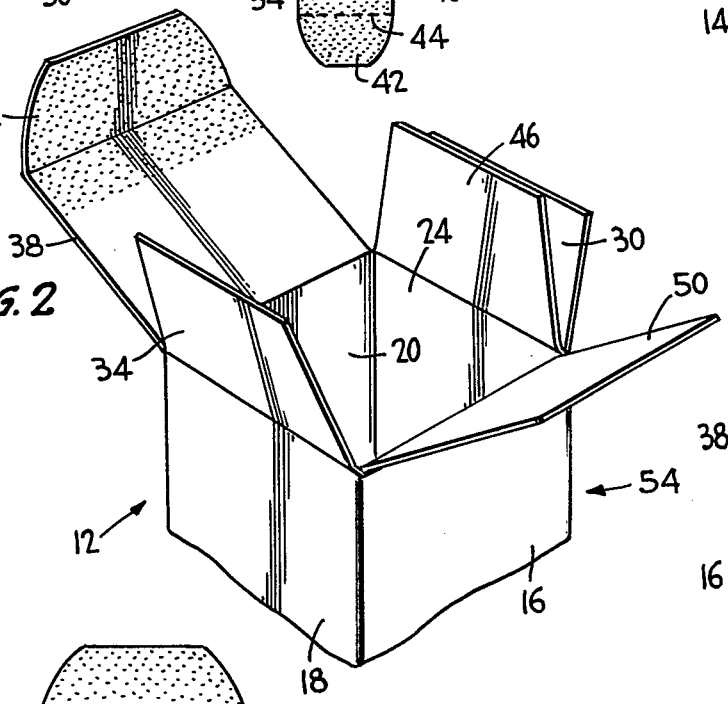
FIG. 2 is an enlarged fragmentary top perspective view of a partially formed carton showing the arrangement of closure panels and flaps at one end thereof.
Figure 4:
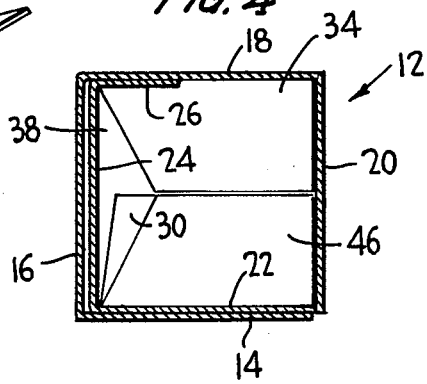
FIG. 4 is a horizontal sectional view taken generally the line 4—4 of FIG. 3 and shows the specific arrangement of the panels which form the four walls of the carton.

The carton 12 is formed in the customary manner from the carton blank 10 by folding the panels 14, 16, 18, 20, 22, 24 and 26 at right angles to the next adjacent panel along the fold lines 28. When the blank 10 is so folded, the inner surface of the terminal panel 14 is bonded to the external surface of the internal panel 22 and the terminal flap or panel 26 is bonded to the interior surface of the exterior panel 18 so as to provide a rectangular or square cross sectional carton body 54 generally illustrated in FIG. 2. The lower end of the carton body 52 will be closed by folding the closure flaps and panels at the bottom of the body 54 in a manner which will be described in detail with respect to the closing of the top of the carton.

First of all, it is to be noted that the closure flaps 30, 46 are bonded together and may be folded inwardly as a unit together with the closure flap 34. Then the closure flap 50 is folded inwardly into overlying relation to the closure flaps 30, 46 and 34. At this time, it is pointed out that the body panels 16 and 24, while they form outer and inner panels of a double wall on the carton 12, they are not adhesively bonded together and thus may be separated. Thus when the closure panel 38 is folded into a carton end closing position, the tuck panel 42 thereof may be inserted between the panels 16 and 24 and the inner surface of the tuck panel 42 may be adhesively bonded to the exterior surface of the inner panel 24. The net result is a bond between the tuck panel 42 and the carton body 54 which is totally inaccessible.

Figure 5:
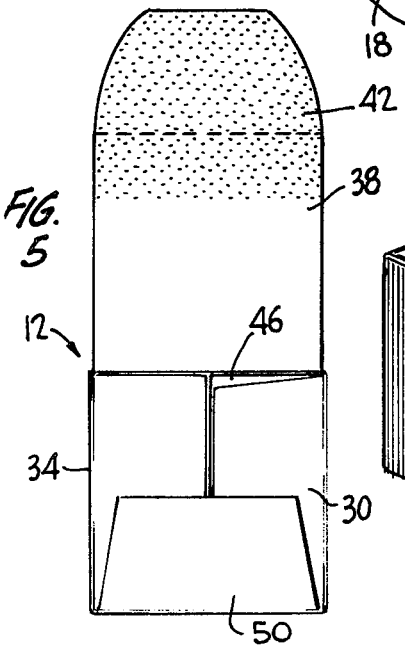
FIG. 5 is a top view of the carton with the top wall thereof being partially formed.

At this time, with particular reference to FIG. 5, it is to be understood that the underside of the closure panel 38 may also have adhesive thereon for bonding to the closure flap 50. On the other hand, the outermost surfaces of the folded closure flaps 30, 34 and 50 may have adhesive applied thereto for bonding to the under surface of the closure panel 38.

Figure 6:
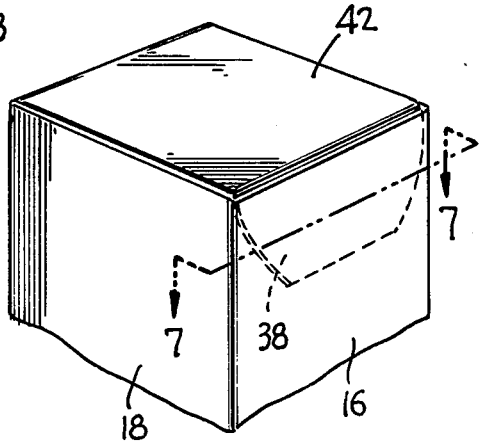
FIG. 6 is a fragmentary top perspective view of the sealed carton.
Figure 7:
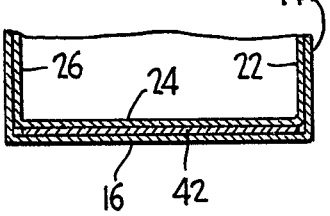
FIG. 7 is a fragmentary horizontal sectional view taken generally along the line 7—7 of FIG. 6 and shows the details of the tuck flap with respect to the carton double wall with which it is associated.

With reference to FIGS. 6 and 7, it will be seen that there is no way that the opposite ends of the resultant carton 12 can be opened and resealed without giving evidence of tampering.

Figure 3:
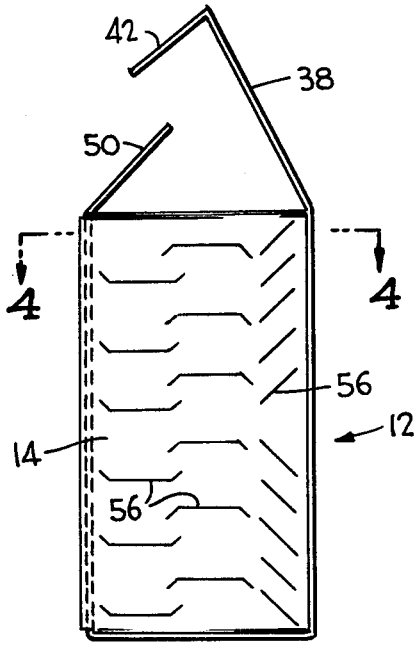
FIG. 3 is a side elevational view of the carton of FIG. 2 viewed from the right side thereof and it shows the specific details of an arrangement of weakening lines formed in the outer panel of that wall of the carton.

Referring once again to FIG. 3, it will be seen that since the terminal flap or panel 26 is bonded to the interior surface of the exterior panel 18 in an inaccessible position, there is no way that one can separate the panels 18 and 26. This leaves the only possible entrance into the carton 12 through the adhesive bond between the terminal panel 14 and the interior panel 22. Inasmuch as these two panels are bonded together by an overall layer of adhesive, it will be seen that a large area of adhesive bond must be removed and this will undoubtedly require weakening of the terminal panel 14. With reference to FIG. 3, it will be seen that the terminal panel 14 is provided with an arrangement of weakening lines 56 which may be generally U-shaped or straight line or a combination thereof as shown with the weakening lines 56 being so arranged that if there is any attempt to open the seam between the panels 14 and 22, this tampering will be readily indicated by a rupture of the terminal panel 14 along the weakening lines and therebetween. The weakening lines 56 are preferably in the form of cuts.

Figure 8:
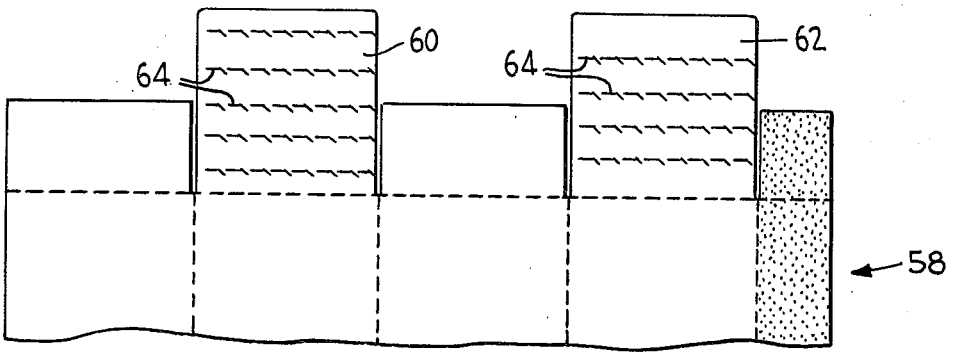
FIGS. 8, 9 and 10 are fragmentary blank and top perspective views of yet another carton wherein top closure panels are provided with matching arrangement of weakening lines for tamper indicating purposes and opening the carton.
Figure 9:
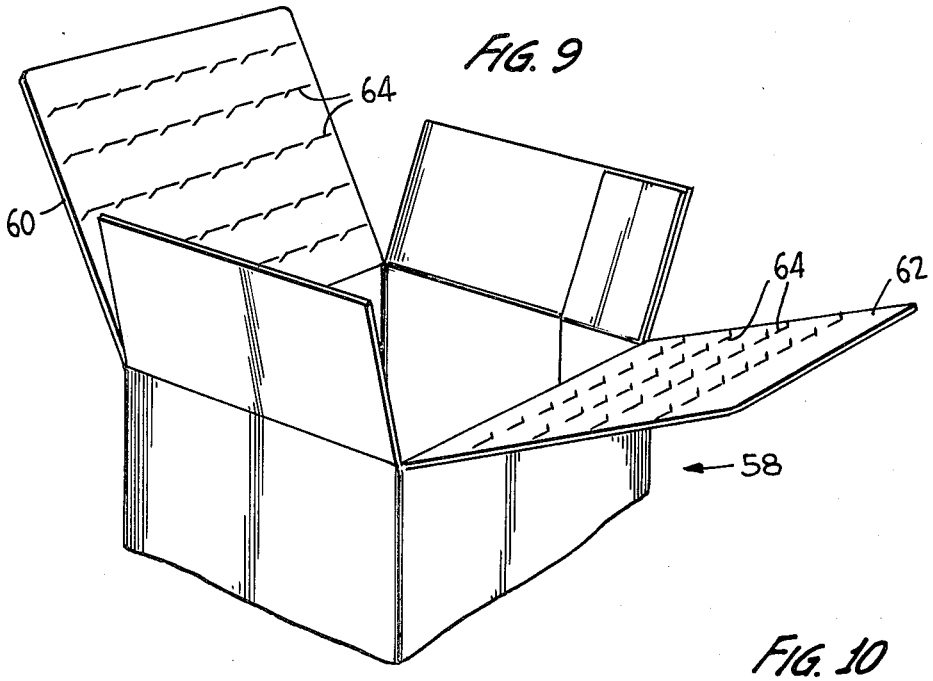
Figure 10:
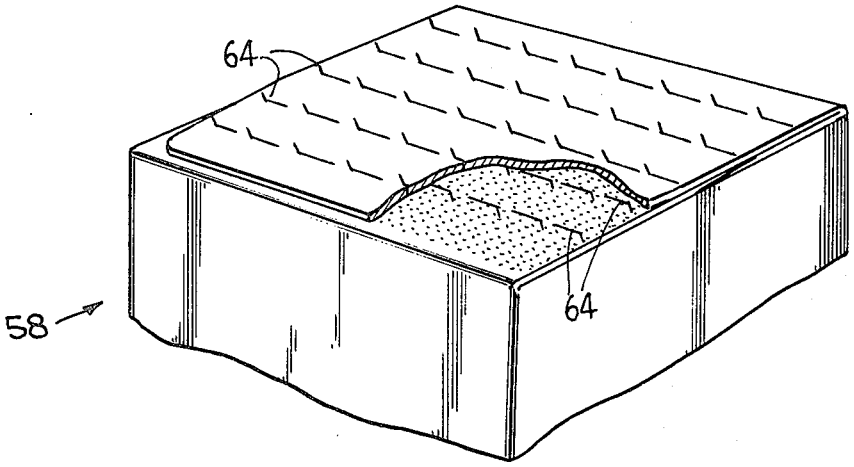

Reference is now made to FIG. 8 wherein there is illustrated a less complex tamper indicating closure for a conventional type of carton. The illustrated carton is identified by the numeral 58 and has a pair of closure flaps or panels 60, 62. Each of the closure panels 60, 62 will be provided with a series of weakening lines 64, which may be in the form of cuts, which weakening lines are substantially duplicated so that when the closure flap 62 overlies and is bonded to the closure flap 60, the weakening lines 64 in the two closure flaps or panels will be matched.

By providing the weakening lines 64 in rows extending transversely of the closure panels or flaps 60, 62, it will be seen that the bonded together closure panels 60, 62 have transverse lines of weakness along which the bonded together closure panels 60, 62 may be torn to effect opening of the carton.

Although only several preferred embodiments of tampering resisting seals have been specifically illustrated and described, it is to be understood that minor variations may be made in the tamper indicating seals without departing from the spirit and scope of the invention as defined by the appended claims.

We claim:

1. A carton comprising a plurality of panels arranged to form walls of said carton, said walls including at least first and second pairs of walls with the walls of each pair being remotely disposed, said first pair of walls including first and second walls, said first wall of said first pair being a double wall and including inner and outer panels, said second pair of walls including first and second walls each of a double wall construction and being disposed next adjacent said first wall of said first pair of walls, said first wall of said second pair of walls including a first terminal panel and a first intermediate panel with said terminal panel being bonded to the interior of said intermediate panel, said second wall of said second pair of walls including a second terminal panel and a second intermediate panel, said second terminal panel being an exterior panel having an interior surface thereof bonded to said second intermediate panel, said second terminal panel having free edge disposed remote from said first wall of said first pair of walls and being generally of the same width as said second intermediate panel, said carton has at least one closed end formed by a plurality of closure members; said closure members including an outer closure flap hingedly carried by said second terminal panel, an inner closure flap hingedly carried by said second intermediate panel, said inner closure flap and said inner closure flaps being bonded together and folded to form part of said closed end and to prevent separation of said second terminal panel from said second intermediate panel, an outer closure panel hingedly carried by said second wall of said first pair of walls and overlying said closure flaps, said closure panel terminating in a tuck flap positioned between said inner and outer panels of said first wall of said first pair of walls, and securing means permanently bonding an inner surface of said tuck flap to an outer surface of said inner panel at a location which is completely inaccessible in the sealed carton.

2. A carton according to claim 1 wherein said inner panel carries a closure flap which underlies said closure panel.

3. A carton according to claim 1 wherein said second terminal panel has formed therein an arrangement of weakening lines, said weakening lines forming tamper indicating means.

4. A carton according to claim 3 wherein said weakening lines are cut lines.

5. A carton blank for forming a tamper proof carton, said carton blank comprising a plurality of full height carton body forming panels arranged in a line and including two terminal panels and at least five intermediate panels including first, second, third, fourth and fifth intermediate panels in order from a first of said terminal panels to a second of said terminal panels, said first terminal panel having adhesive thereon for securement to an interior surface of said fourth intermediate panel, said second terminal panel having adhesive thereon for securement to the exterior of said second intermediate panel, said first and fifth intermediate panel being overlapable, and closure forming means at each end of said panel including a first flap carried by said second terminal panel for underlying a second flap carried by said second intermediate panel, adhesive on an inner surface of said first flap for bonding to said second flap, a closure panel carried by said third intermediate panel and carrying a tuck flap, and adhesive on an interior surface of said tuck flap for bonding said tuck flap to said first intermediate panel when said tuck flap is positioned between said first and fifth intermediate panels.

6. A carton blank according to claim 5 wherein said second terminal panel has formed therein an arrangement of weakening lines, said weakening lines forming tamper indicating means.

7. A carton blank according to claim 5 wherein said first intermediate panel has a closure flap for underlying and bonding to said closure panel.

8. A carton blank according to claim 7 wherein said fourth intermediate panel carries a closure flap for underlying said closure panel.

9. A carton blank according to claim 5 wherein said fourth intermediate panel carries a closure flap for underlying said closure panel.

* * * * *